United States Patent [19]

Oda

[11] 4,262,502

[45] Apr. 21, 1981

[54] SLIDER WITH LOCK FOR A SLIDE FASTENER

[75] Inventor: Kiyoshi Oda, Kurobe, Japan

[73] Assignee: Yoshida Kogyo K.K., Tokyo, Japan

[21] Appl. No.: 42,540

[22] Filed: May 25, 1979

[30] Foreign Application Priority Data

May 26, 1978 [JP] Japan ..... 53-72097[U]

[51] Int. Cl.[3] ..... E05B 67/38

[52] U.S. Cl. ..... 70/68

[58] Field of Search ..... 70/68; 24/205 R, 205.11 R, 24/205.14 R, 205.14 K, 205.14 A, 205.15 R; 190/41 Z

[56] References Cited

U.S. PATENT DOCUMENTS

| | | | |
|---|---|---|---|
| 2,166,581 | 7/1939 | Carlile | 70/68 |
| 2,188,620 | 1/1940 | Boenecke | 70/68 |
| 3,270,535 | 9/1966 | Fukuroi | 70/68 |
| 4,015,457 | 4/1977 | Fukuroi | 70/68 |

FOREIGN PATENT DOCUMENTS

| | | | |
|---|---|---|---|
| 1036410 | 7/1966 | United Kingdom | 70/68 |

*Primary Examiner*—Robert L. Wolfe

*Attorney, Agent, or Firm*—Hill, Van Santen, Steadman, Chiara & Simpson

[57] ABSTRACT

A slider with lock for a slide fastener is provided of which the built-in lock comprises (a) a cylindrical housing integrally fixed onto the upper wing of the slider body and provided with a sloped cam face on the inner surface thereof, (b) a rotor coaxially installed within the housing, capable of being turned with a key and capable of moving in the axial direction when turned by being guided along the sloped cam face on the inner surface of the housing, (c) a locking member with a lock claw directed toward the element rows of the slide fastener and engaged with the rotor so as to be moved in the axial direction of the rotor by rotating by being guided along the sloped cam face, (d) a spring interposed between the rotor and the locking member so that the locking member is always urged toward the element rows, and (e) a cover. With this structure of the lock, the element rows are locked by being jammed with the lock claw which is pressed firmly by the compressive resilience of the spring.

5 Claims, 5 Drawing Figures

SLIDER WITH LOCK FOR A SLIDE FASTENER

BACKGROUND OF THE INVENTION

The present invention relates to a slider with lock for a slide fastener or, in particular, to a slider with lock having an improved structure in which the rows of the fastener elements are locked by being jammed with a pointed lock claw engaging the element rows from above by turning a key inserted into the lock.

Many sliders for slide fasteners are provided with a lock to prevent inadvertant opening of the slide fastener. There are hitherto known several types of sliders having a built-in locking mechanism in which the element rows are jammed by a lock claw engaging the elements from above. Such a kind of lock is usually constructed by providing a rotor and a locking member with a lock claw in a housing and the locking member is moved up and down by the rotation of the rotor, being urged downwardly by a compression spring. In the sliders with locks known in the prior art as described above, however, a problem is that the compression spring in the lock is strongly compressed when the locking member is in the uppermost position to unlock the lock while the spring is subject to relatively weak compression force when the locking member is lowered so that the lock claw is in contact with the element rows to be locked. In other words, the locking member with the lock claw is forcibly lowered in counteracting the upward resilience exerted by the compression spring so that the reliability in locking is somewhat reduced (see, for example, Japanese Utility Model Publications Nos. 41-9314 and 42-9050).

SUMMARY OF THE INVENTION

It is therefore an object of the invention to provide a slider with lock for a slide fastener free from the above-described problem in the prior art sliders and capable of locking a slide fastener with high reliability.

The slider of the invention comprises:

(a) a cylindrical housing integrally fixed on the upper wing of the slider body and provided with a sloped cam face on the inner surface thereof, (b) a rotor coaxially installed within the housing, capable of being turned with a key and capable of moving in the axial direction when rotated, being guided along the sloped cam face on the inner surface of the housing, (c) a locking member with a lock claw directed toward the element rows and engaged with the rotor so as to be moved in the axial direction of the rotor by the axial movement of the rotor, (d) a spring interposed between the core member and the moving member so that the moving member is always urged toward the element rows, and (e) a cover.

DETAILED DESCRIPTION OF THE PREFERRED EMBODIMENTS

Figure 1:
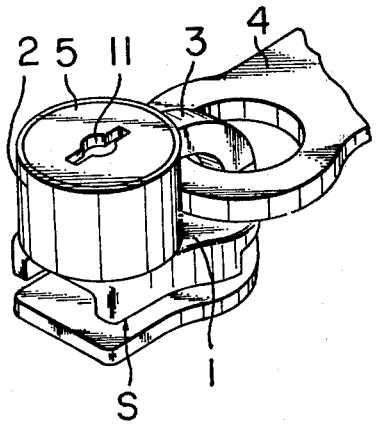
FIG. 1 is a perspective view of a preferred slider with lock embodying the invention.

As shown in the drawings, particularly FIG. 1 showing the perspective view of the preferred slider, the slider comprises a slider body S, a housing 2 integrally fixed on to an upper wing 1 of the slider body S, a pull tab 4 and a shackle 3 with which the pull tab 4 is engaged. The housing 2 is provided with a cover 5 provided with a key hole 11.

Figure 2:
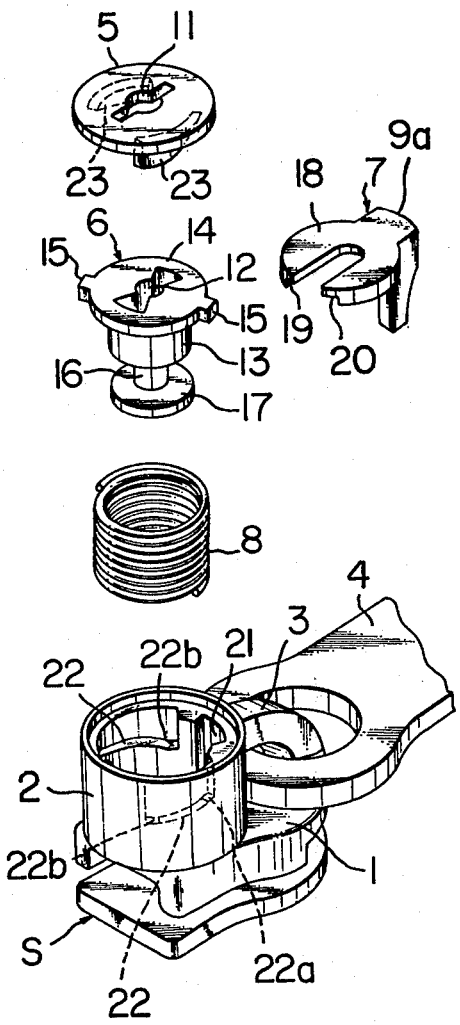
FIG. 2 is a perspective view of the preferred slider with lock with the lock thereof disassembled into parts.

FIG. 2 illustrates the perspective view of the slider of which the lock is disassembled into the cover 5, a rotor 6, a locking member 7 and a spring 8 dismounted from the housing 2. On the inner surface of the housing 2 are provided a claw guide groove 21 running in the axial direction and a pair of sloped cam faces 22, 22 in radially opposite positions in the inner wall of the housing 2. Each of the sloped cam faces 22, 22 is provided with horizontal flats **22*a* and 22*b*** at the upper and lower ends thereof, respectively.

The rotor 6 is composed of an upper flange 14, a trunk 13, a lower flange 17 and a pivotal shaft 16 connecting the trunk 13 and the lower flange 17. The upper flange 14 has two sliding points in the form of projections 15, 15 in radially opposite positions and is provided with a key guide 12 of a shape to fit a key. This rotor 6 is installed in the housing 2 coaxially with the periphery of the upper flange 14 in smooth contact with the inner wall of the housing 2 and each of the projections 15, 15 resting on one of the sloped cam faces 22, 22. Thus, when the rotor 6 is turned with a key inserted into the key guide 12 through the key hole 11 in the cover 5, the rotor 6 is moved in the axial direction at it rotates by the projections 15, 15 sliding along the sloped cam faces 22, 22.

The locking member 7 is in an L-shaped configuration as viewed from one side and comprises a hook plate 18 and a lock claw 9 extending perpendicularly from the hook plate 18 at one end thereof. The hook plate 18 has a diameter, preferably, just to fit the inner wall of the housing 2 so that the locking member 7 can move smoothly in the axial direction within the housing 2. The hook plate 18 is bifurcated with a pair of legs being provided with a notch 19 at which the hook plate 18 is engaged with the pivotal shaft 16 of the rotor 6 so that the locking member 7 is moved in the axial direction of the rotor 6 by the movement of the rotor 6 in the axial direction. In particular, the hook plate 18 is provided with a recess 20 on the back surface thereof, the recess 20 being of such a dimension that the lower flange 17 of the rotor 6 just fits the recess 20 whereby the stability of the engagement of the rotor 6 and the locking member 7 is increased.

When the locking member 7 is installed within the housing 2 in engagement with the rotor 6, the back portion **9*a* of the lock claw just fits the claw guide groove 21 provided on the inner surface of the housing 2 so that the smoothness of the movement of the locking member 7 in the axial direction is improved by being guided along the claw guide groove 21 at the back portion 9*a* of the locking member 7**.

In the assemblage of the rotor 6 and the locking member 7, the coiled spring 8 is inserted between them so that the hook plate 18 of the locking member 7 is always urged towards the lower flange 17, which engages the recess 20 on the back surface of the hook plate 18.

After the rotor 6, locking member 7 and spring 8 are installed within the housing 2 in a manner described above, the cover 5 is laid on the housing 2 where the cover 5 is integrally fixed to the housing 2 by soldering or by using a suitable adhesive agent so as to be resistant to destructive force.

The cover 5 is provided with a pair of archwise projections 23, 23 each in a form of something like a curved triangle extending downwardly. When the cover 5 is laid on the housing 2, the projections 23, 23 are each positioned to face a respective one of the sloped cam faces 22, 22 so that a groove 24 is formed between the sloped cam face 22 and the lower surface **23*a* of the projection 23. The projections 15, 15 of the upper flange 14 in the rotor 6 are pushed into these grooves 24, 24 so that the movement of the rotor 6 in the axial direction is totally under the guidance of these grooves 24, 24 in sliding contact with the projections 23, 23**.

Figure 3:
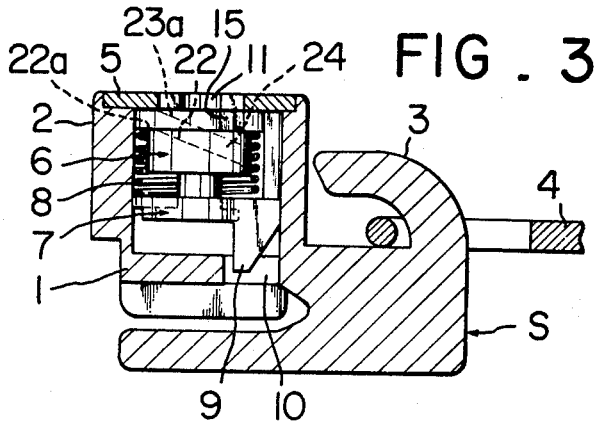
FIG. 3 is a cross sectional view of the preferred slider with lock showing the unlocked state of the lock thereof.
Figure 4:
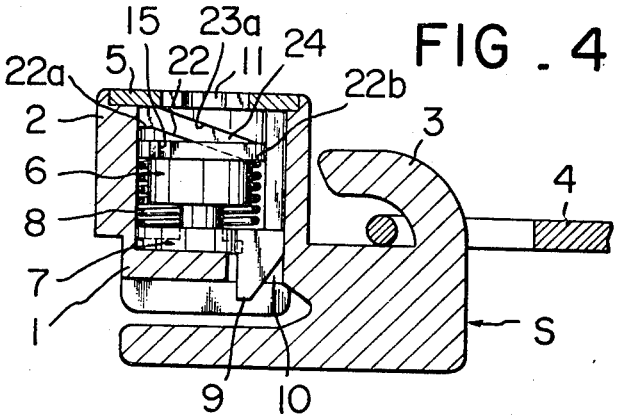
FIG. 4 is a cross sectional view of the preferred slider with lock showing the locked state of the lock thereof in the absence of element rows extending therethrough.
Figure 5:
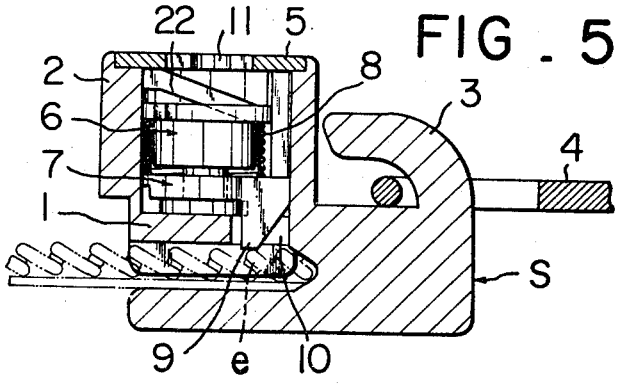
FIG. 5 is a cross sectional view of the preferred slider with lock showing the locked state of the lock thereof with the element rows extending therethrough.

FIGS. 3 to 5 illustrate the operational movements of the parts of the lock in the slider.

In FIG. 3, illustrating the lock in the unlocked state, the rotor 6 is at the uppermost position and the projections 15, 15 each rest on the upper horizontal flat **22*a* of the sloped cam face 22. The locking member 7 is lifted by being pulled up at the recess 20 by the lower flange 17 of the rotor 6 so that the point of the lock claw 9 is apart from the element rows e, permitting free sliding of the slider body S along the element rows e by someone pulling the pull tab 4. Because the projections 15, 15 of the rotor 6 rest on the horizontal flats 22*a*, 22*a*, there can be no inadvertent or spontaneous transfer to the locked state of the lock unless the rotor 6 is turned by use of a key through the key hole 11**.

When the slide fastener is to be locked with the slider at a desired position, the rotor 6 is turned with a key inserted through the key hole 11 into the key guide 12 so that the rotor 6 moves in the axial direction by a screw motion sliding on the grooves 24, 24 at the projections 15, 15, rotating down to the lowermost position as is shown in FIG. 4, illustrating the locked state of the lock without the element rows e. In this case, the projections 15, 15 come to rest on the lower horizontal flats **22*b*, 22*b*, respectively, and the locking member 7 is pressed downwardly by the spring 8 and, accordingly, the point of the lock claw 9 is projected downwardly through the opening 10 provided in the upper wing 1 of the slider body S. When element rows e extend through the slider body S as in the actual use of the slider, the point of the lock claw 9 comes into contact with the elements so that the locking member 7 is in a somewhat raised position as is shown in FIG. 5 in comparison with FIG. 4, pushing the spring 8 upwardly. In other words, the locking member 7 is pressed downwardly by the compressive resilience of the spring 8 while the position of the rotor 6 in FIG. 5 is the same as in FIG. 4 because the position of the rotor 6 is determined solely by the rotation of the projections 15, 15 relative to the grooves 24, 24**.

The rotor 6 is always urged upwardly by the compressive resilience of the spring 8 but there can be no inadvertent or spontaneous transfer to the unlocked state because the projections 15, 15 rest on the lower horizontal flats **22*b*, 22*b* and cannot move upwardly unless the rotor 6 is turned with a key. Thus, the element rows e are jammed with the point of the lock claw 9 always with a good reliability because the contacting pressure between the lock claw 9 and the element rows e is obtained by the downward resilience of the spring regardless of whether the point of the lock claw 9** is in contact with the element rows e at just the head of an element or at the recess between neighboring elements.

What we claim is:

1. A slider with lock for a slide fastener which comprises (a) a cylindrical housing integrally fixed on the upper wing of the slider body and provided with a sloped cam face on the inner surface thereof, (b) a rotor coaxially installed within the housing, capable of being turned with a key and capable of moving in the axial direction when rotated, being guided by the sloped cam face on the inner surface of the housing, (c) a locking member with a lock claw directed toward the element rows of the slide fastener and engaged with the rotor so as to be moved in the axial direction of the rotor by the axial movement of the rotor, (d) a spring interposed between the rotor and the lockign member so that the locking member is always urged toward the element rows, and (e) a cover.

2. A slider as claimed in claim 1 wherein the housing is provided with a lock claw guide on the inner surface thereof and the locking member is movable by being guided along the lock claw guide.

3. A slider as claimed in claim 1 or 2 wherein the rotor is provided with a projection by means of which the rotor is guided along the sloped cam face on the inner surface of the housing.

4. A slider as claimed in claim 1 wherein the sloped cam face has an upper horizontal flat and a lower horizontal flat at upper and the lower ends thereof, respectively.

5. A slider as claimed in claim 1 or 2 or 4 wherein the cover has a downward projection facing the sloped cam face to form a groove therebetween.

* * * * *